United States Patent [19]

Meinders

[11] 4,069,406

[45] Jan. 17, 1978

[54] CLOSING RESISTOR SWITCH FOR GAS INSULATED CIRCUIT BREAKER

[75] Inventor: Gerardus J. Meinders, Florence, Miss.

[73] Assignee: Allis-Chalmers Corporation, Milwaukee, Wis.

[21] Appl. No.: 636,824

[22] Filed: Dec. 2, 1975

[51] Int. Cl.[2] ..... H01H 33/16

[52] U.S. Cl. ..... 200/144 AP; 200/145; 338/115; 338/204; 338/295

[58] Field of Search ..... 200/144 AP, 145; 338/115, 204, 288, 295, 289

[56] References Cited

U.S. PATENT DOCUMENTS

| | | | |
|---|---|---|---|
| 2,324,047 | 7/1943 | Ryan | 200/144 AP |
| 3,576,458 | 4/1971 | Smith, Jr. | 200/144 AP |
| 3,863,041 | 1/1975 | Rostron et al. | 200/144 AP |

FOREIGN PATENT DOCUMENTS

| | | | |
|---|---|---|---|
| 18,808 | 1968 | Japan | 200/144 AP |

*Primary Examiner*—Robert S. Macon
*Attorney, Agent, or Firm*—Robert C. Jones

[57] ABSTRACT

A high voltage gas insulated circuit breaker in which a resistance shunts the main interrupter contacts to control the magnitude of the surge voltage experienced when the interrupter is closing. The resistance includes a resistor switch comprising a plurality of stacks of resistor segments connected in parallel. The smaller surface area of the segments tends to resist cracking due to mechanical thermal stresses and provides a higher resistivity thereby being capable of withstanding more voltage. The parallel stacks of resistor segments provides for a more compact resistor switch without sacrificing the basic operational requirement.

9 Claims, 4 Drawing Figures

CLOSING RESISTOR SWITCH FOR GAS INSULATED CIRCUIT BREAKER

BACKGROUND OF THE INVENTION

This invention relates to gas insulated circuit breakers having a closing resistor switch therefor which has a high resistivity and has the ability to withstand high voltage accompanying the closing of the circuit breaker contacts.

The utilization of gas high voltage insulated circuit breakers in substation installations in recent years has resulted in smaller, more compact circuit breaker enclosures without a decrease in the voltage rating and often with a voltage rating increase. Thus, the smaller envelope and higher voltage rating requires compact components so as to provide adequate insulating spacing from other components and also from the envelope itself. These more compact components, however, must provide the necessary function for which they are intended.

When the interrupter contacts of a circuit breaker are closed voltage surges are experienced. To dampen the overvoltage on the line it is well known to preinsert a resistance in the circuit during the closing operation just prior to the closing of the interrupter contacts. This is shown in U.S. Pat. No. 3,291,947 and U.S. Pat. No. 3,390,239 as well as in a paper published in the IEEE Transactions on Power Apparatus and Systems, December 1964, — Switching of EHV Circuits, II — Surge Reduction with Circuit Breaker Resistors — by Hedman et al.

The circuit breaker which incorporates the present invention includes an enclosure filled with an insulating gas at a relatively low pressure. Within the enclosure are several serially connected main interrupters. A resistor switch is associated with each interrupter and is connected to shunt the contacts thereof. Each resistor switch comprises a pair of relatively movable contacts operable to electrically connect a plurality of parallelly connected segmental resistor stacks into the shunt connection to thereby withstand the high voltage surge present at interrupter closing. These resistor switches must be contained and protected by the shielding arrangement provided for the interrupters. However, with presently known resistors to provide the resistivity necessary to withstand the high voltage stresses experienced with 345 Kv to 550 Kv or higher rated circuit breakers these known resistors would have to be exceedingly long to provide the necessary resistance. With the limited space available within the interrupter enclosure and between the interrupter shields, a long resistor switch cannot be utilized.

SUMMARY OF THE INVENTION

It is the general object of the present invention to provide a resistor switch of compact geometry having high resistivity and capable of withstanding the high dielectric stresses experienced with circuit interrupters of high voltage rating.

In accordance with this invention there is provided a resistor switch of compact geometry comprising a plurality of parallel resistor stacks. To provide a high resistivity the surface area of the stacks are reduced to a minimum and are configured as segments of a cylinder. The several stacks of resistors are maintained in parallelism but maintained separate from each other by insulator rods. The several stacks are arranged in circular array around a ceramic tensioning rod. Intimate engagement of the resistors of each stack is effected by the continued application of a compression force to the stacks. The fixed or stationary contact is associated with the resistor stacks while the movable contact is spaced in fixed relationship to the stationary contact. The entire assembly being disposed within a cylindrical housing of a length and of a diameter to be accommodated within and between the shields associated with an interrupter.

DESCRIPTION OF THE INVENTION

Figure 1:
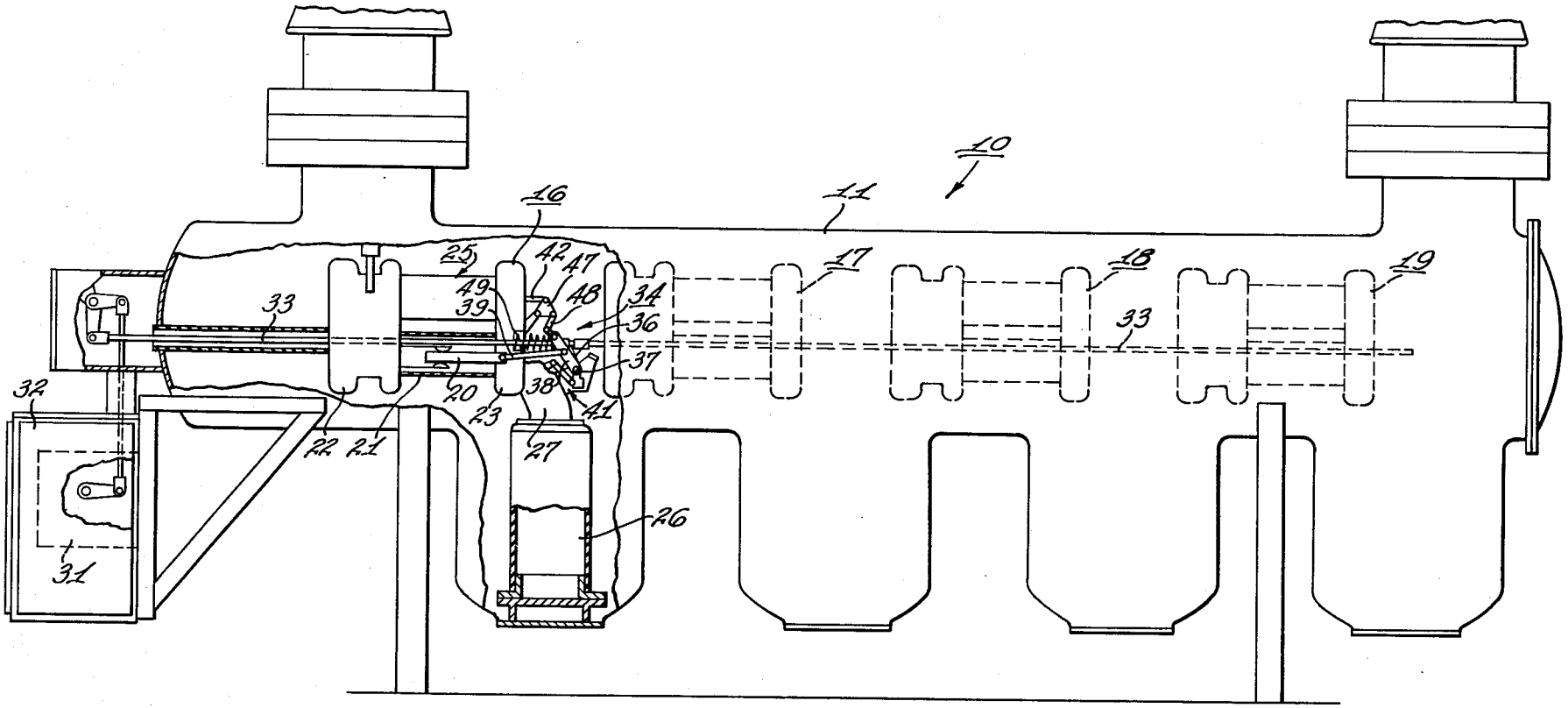
FIG. 1 is a longitudinal plan view of a gas insulated circuit breaker with a portion of the enclosure broken away to show one of the several interrupters therein and the associated resistor switch.

As shown in FIG. 1, a gas insulated circuit breaker 10 comprises a gas tight enclosure 11 in which insulating gas at a relatively low pressure is contained. Within the enclosure 11 several serially connected interrupters 16, 17, 18 and 19 are disposed. The interrupters are identical, thus a general description of the interrupter 16 will apply to all of the interrupters. Interrupter 16 includes a pair of separable contacts 20 disposed within a cylindrical insulator housing generally denoted by the reference number 21. The contacts 20 are supported in a horizontal plane between a relatively large metallic end shield 22 and a relatively small metallic end shield 23. Also supported within the limited space between the shields 22 and 23 is a resistor switch generally denoted at 25.

Arc extinguishing gas at a relatively high pressure is contained within a storage tank 26 which also serves to support the interrupter 16 in operative position within the enclosure 11. A blast of high pressure gas from the storage tank 26 is released to the contact arcing area by operation of a blast valve mechanism (not shown) located within a housing 27. The housing 27 serves to connect the interrupter 16 to the storage tank 26 and to direct the blast of high pressure gas to the arcing area of the contacts 21.

The synchronous operation of the main interrupter contacts 20, the resistor switch 25 and the blast valve is effected by operation of an operator 31 located within a cabinet 32. Operation of the operator 31 in a first direction will effect leftward movement of several connected acceleration rods 33. The accelerator rods are connected to operating linkage 34 associated with each interrupter. For a detailed description of the operating linkage 34 reference may be had to United States patent application of George K. Benham, Ser. No. 443,919, and assigned to the assignee of this application. In general one end of an actuating arm 36 is connected to the accelerating rod 33 and has its opposite end connected to rotate a transversely extending horizontal shaft 37. An operating arm 38 is connected to the shaft 37 to be driven thereby. The arm 38 in turn is connected via a link 39 to the movable contact of the interrupter contacts 20 to effect a closing or opening movement of the contact.

In addition, linkage 41 associated with the operating arm 38 is actuated to open the blast valve (not shown) in synchronism with the opening of the movable interrupter contact. Also, the synchronous operation of the resistor switch 25 in relationship to the closing movement of the interrupter contacts is accomplished. To this purpose a connecting rod 42 has one end connected to effect closing movement of a movable resistor switch contact rod 46 as will be more fully described. The opposite end of the connecting rod 42 is pivotally connected to one corner of a bell crank 47. The fulcrum point of the bell crank 47 is pivotally connected to a fixed abutment. A two-part toggle link 48 is operatively connected between the bell crank 47 and the operating arm 38.

The arrangement is such that leftward movement of the accelerator rod 33, as viewed in FIG. 1, under the influence of the operator 31 will serve to effect the movement of the movable contact of the interrupter contacts 20 to closed position. At this time the resistor switch linkage 48 is effective to operate the resistor switch 25 to close the resistor switch 25 just prior to the closing of the interrupter contacts 20. However, the linkage 41 associated with the blast valve is not activated at this time and the blast valve is maintained in closed position. As the acceleration rod 33 is moved leftwardly it compresses associated accelerating springs 49 to store energy therein for a subsequent contact opening operation. This opening operation is accomplished when the operator 31 is tripped to thereby release the accelerating rod 33. With the operator 31 tripped the stored energy in the accelerator springs 49 will effect rightward movement of the accelerator rod 33 and thereby effect the operation of the linkages; the blast valve will be operated to direct a blast of high pressure gas to the arcing area as the interrupter contacts open.

Figure 2:
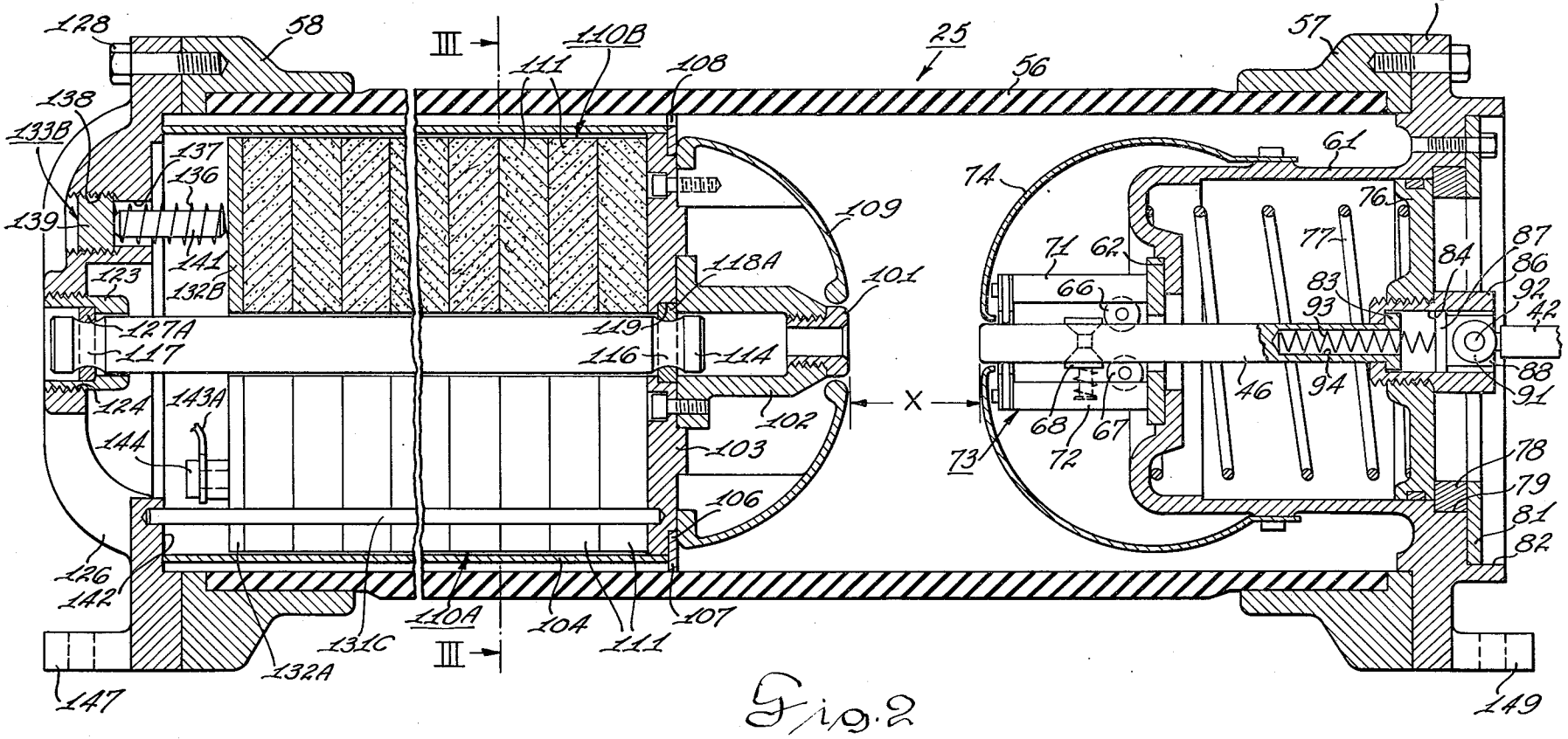
FIG. 2 is a view in longitudinal vertical section through the resistor switch.

The resistor switch 25 is shown in detail in FIG. 2 and comprises an insulating elongated cylindrical housing 56 the ends of which are encompassed in metallic cup members 57 and 58. The cup member 57 is adapted to receive an end closure member 59 which is screw fastened in position to the cup member 57. The end closure member 59 has integrally formed with it an axial leftwardly extending cylinder 61 the free end of which is reverted inwardly and backwardly to form a circular flat surface 62.

Disposed within the cylinder 61 and extending leftwardly and outwardly thereof is a movable contact rod 46. The leftwardly extending end of the contact rod 46 extends through an axial opening formed in the flat surface 62 and into guide engagement with two pairs of contact guide rollers 66 and 67, and 68 and 69. The contact guide rollers 66 and 67 are engaged with the contact rod 46 and also with respective rod members 71 and 72 of a cage 73. The contact guide rollers 68 and 69 of which only the contact guide roller 68 is shown are displaced 90° with respect to the disposition of the contact guide rollers 66 and 67. The contact guide rollers 68 and 69 are likewise engaged with the contact rod 46 and with cage rods (not shown) similar to the rods 71 and 72. The cage 73 is secured onto the flat surface 62 to provide axial guidance to the contact rod 46 as it is moved leftwardly to a closed position or rightwardly to the open position, as depicted in FIG. 2. Surrounding the cage member 73 and the free end of the contact rod 46 and fitting well back on the cylinder 61 is a shield 74 through which the contact rod 46 is free to move.

To maintain the contact rod 46 in rightward open position and to insure the retraction of the contact rod from closed to open rightward position there is provided a piston 76 which is movably disposed within the cylinder 61. A spring 77 operating between the closed end of the cylinder 61 and the piston 76 constantly urges the piston rightwardly. To prevent the piston 76 from moving out of the cylinder 61 there is provided a stop ring 78 which is seated within a counterbore 79 formed in the end closure member 59. A retainer plate 81, screw fastened within another counterbore 82, retains the stop ring 78 within its counterbore 79.

The right end of the contact rod 46 is provided with an enlarged circular head 83 that is slidable within a bore 84 of a nut 86. The left hand end of the nut 86, as viewed in FIG. 2, is of reduced diameter and threaded to engage in a threaded axial opening formed in the piston 76. A yoke member 87 having bifurcated rightwardly extending ends 88, one of which is shown, is disposed within the bore of the nut 86. The connecting rod 42 is provided with a rod end 91 which is disposed between the bifurcated ends 88 of the yoke 87. A pin 92 extends through the enlarged righthand end portion of the nut 86 and through the bifurcated ends 88 of the yoke 87 and the rod end 91 of the rod 42 to secure the rod 42 for movement with the piston 76. Thus, as the connecting rod 42 is moved leftwardly, as viewed in FIG. 2, to move the resistor switch contact rod 46 to a closed position the piston 76 will also move leftwardly within the cylinder 61 compressing the spring 77. Overtravel of the contact rod 46 is provided for by the lost motion arrangement provided by the head 83 of the contact rod 46 movable within the bore 84 of the nut 86. A spring 93 working between the bottom of a blind bore 94 formed in the contact rod 46 and the end face of the yoke 87 operates to constantly urge the contact rod 46 leftwardly. With this arrangement damage to the components due to closing overtravel of the contact rod 46 is avoided by the limited axial rearwardly movement permitted to the contact rod wherein the head portion 83 is free to move within the bore 84 of the nut 86.

In a resistor switch opening movement the stored energy in the spring 77 operates to move the piston 76 rightwardly to return it to the position it occupies as depicted in FIG. 2. The piston 76 in moving rightwardly draws the resistor switch contact rod 46 with it.

The tubular stationary contact 101 of the resistor switch 25 is threadedly engaged in a guide assembly 102. The guide assembly 102 is secured as by screws to an end plate 103 which is secured in the end of a resistor element housing 104. The housing 104 is of an electrical insulating material which in the present instance is fabricated of vacu-cast insulating material. A spacer member 106 serves to center the housing 104 within the switch housing 56. The spacer 106 is formed in a manner to have three equally spaced lobe portions 107, one of which is shown, that provide a segmental space, such as the space 108, between adjacent lobe portions. This arrangement provides for free circulation of low pressure insulating gas between the resistor element housing 104 and the interior of the resistor switch housing 56. A semi-spherical shield 109 which is secured to end plate 103 surrounds the stationary contact 101 and guide assembly 102.

Figure 3:
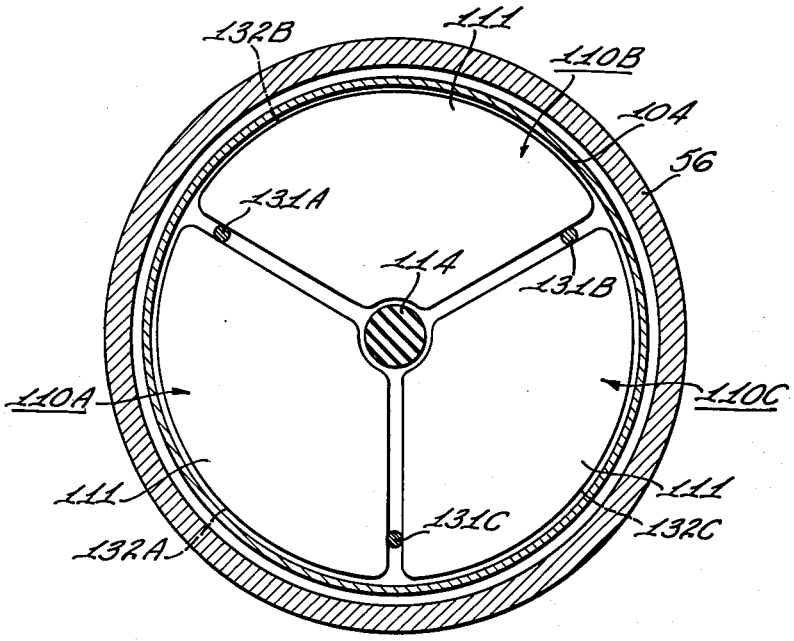
FIG. 3 is a view in vertical section taken in a plane represented by the line III—III in FIG. 2.

Within the resistor element housing 104 there is arranged three stacks 110A, 110B, and 110C of triangularly shaped resistor elements or slugs, as shown in FIGS. 2 and 3. Each of the resistor stacks 110A, 110B and 110C comprise a plurality of individual triangularly configured resistor elements or slugs 111. The triangularly configured resistor element stacks are arranged radially about a central axially disposed ceramic rod 114. The ends of the ceramic rod 114 are formed with annular grooves 116 and 117. As viewed in FIG. 2, the right end of the ceramic rod 114 extends through an axial opening formed in the end plate 103 and into the bore of the guide assembly 102. A two-piece locking guide 118, one-half 118A of which is shown, is recessed within an axial counterbore 119 formed in the end plate 103. The twopiece locking guide is adapted to engage in the annular groove 116 and locks the end of the ceramic rod 114 to the fixed end plate 103. The opposite or left end of the rod 114 is received within a nut 123 which is threadedly engaged in a threaded axial bore 124 formed in an end cap spider 126. A plurality of screws 128 secure the end cap spider 126 to the cup member 58. A two-piece locking guide 127 is disposed within a counterbore formed in the nut 123 and abuts the shoulder formed in providing the counterbore. The locking guide 127 is adapted to engage in the annular groove 117 on the left end of the rod 114 to lock the rod to the end cap spider 126. With the right end of the rod 114 locked in the end plate 103 the nut 123 on the left end of the rod can be adjusted to place the rod 114 in tension.

For maintaining electrical separation between the resistor stacks 110A, 110B and 110C there is provided insulator separator rods 131A, 131B and 131C. The insulator separator rods 131A, 131B and 131C are spaced 120° apart and extend between the end plate 103 and the spider end cap 126. Thus, the resistor stacks 110A, 110B and 110C are electrically isolated from each other within the resistor housing 104.

For maintaining the triangular resistor slugs 111 in each individual stack in intimate contact there is provided metallic end plates 132A, 132B and 132C for each of the stacks 110A, 110B and 110C, respectively. The metallic end plates 132A, 132B and 132C are each disposed within the housing 104 and engage against the bottom surface of the last resistor slug 111 in the associated stack. These end plates are electrically isolated from each other within the housing 104 by operation of the insulator separator rods 131A, 131B and 131C.

Individual pressure applying means 133A, 133B and 133C are provided to insure and maintain an intimate contact between the resistor slugs 111 in each of the stacks. The pressure applying means 133A, 133B and 133C are identical and the description of the pressure means 133B will also pertain to the pressure means 133A and 133C. As shown in FIG. 2, the pressure applying means 133B comprises a compression spring 136 which has its inner end abutting the insulator stack bottom plate 132B. The outer or left end of the spring 136, as viewed in FIG. 2, is confined within the bore 137 formed in an arm of the end cap spider 126. A threaded counterbore 138 portion of bore 137 receives a threaded screw 139 which serves to compress the spring 136 thereby applying pressure to the plate 132B. A guide pin 141 which extends through the spring 136 serves to maintain the spring in straight line force applying condition but is not of a sufficient length to transmit a force between the screw 139 and bottom plate 132B. The force exerted on the metallic plate 132B by the spring 136 is distributed equally over the entire area of the plate so that the plate applies an equalized pressure to the resistor slugs 111. Thus, the resistor slugs 111 in the resistor stack 110B are compressed into intimate engagement between the end plate 103 and the stack end plate 132B.

It will be appreciated that the distance "X", FIG. 2, across the ends of the contacts 46 and 101 as originally established for all the resistor switches utilized in the circuit breaker 10 must always remain the same. However, due to manufacturing tolerances the overall dimensional limits may be exceeded. Under this condition the force exerted by the springs 136 of the pressure means 133A, 133B and 133C together with the variation in manufacturing tolerances could be sufficient to displace the entire resistor housing tube 104 from its seated position on the circular seat 142 formed in the exterior surface of the spider end cap. This of course would effect a variation in the distance "X" across the contacts to something less than that which was originally established. However, the tension on the ceramic rod 114 can be adjusted through manipulation of the nut 123 to counteract any displacing force that may occur. Thus, the tension rod 114 serves to provide an adjustment for the contact 101 and also locks the resistor housing 104 to the end cap spider 126.

Figure 4:
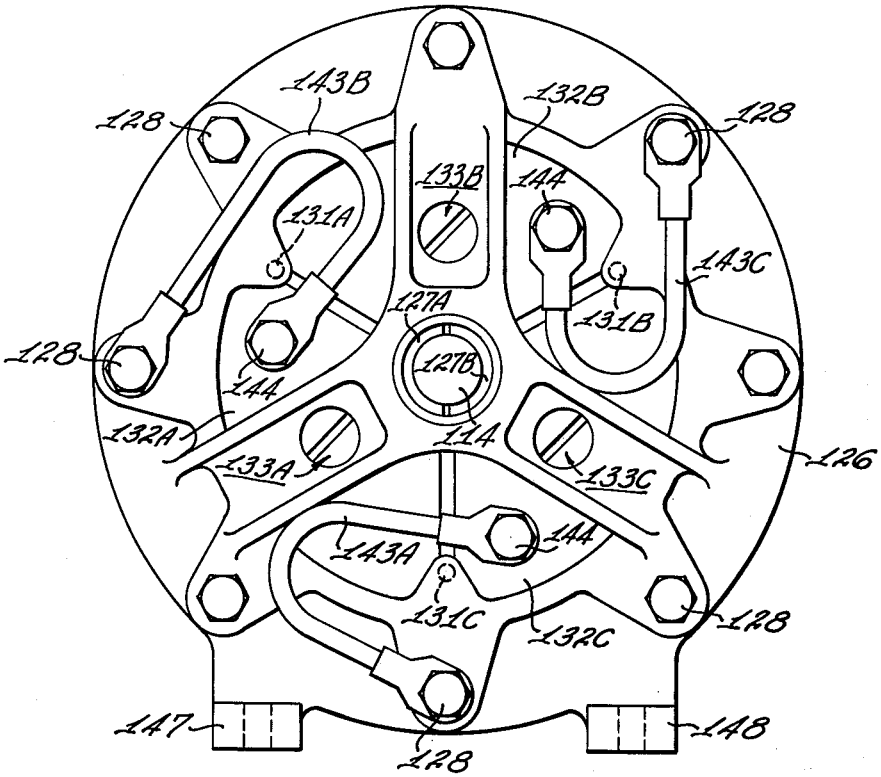
FIG. 4 is an end view of the resistor switch as viewed from the left of FIG. 2 showing the electrical interconnecting end plate.

The resistor stacks 132A, 132B and 132C are connected in parallel to the stationary contact 101. To this end, conductors 143 are connected between the left ends of the stacks and the metallic end cap spider 126. As shown in FIG. 4, one end of a conductor 143A is connected to a metallic screw 144 that is threadedly engaged in a boss formed on the slug end plate 132C. The opposite end of the conductor 143A is connected to an end assembly screw 128 which secures the spider to the metallic cup 58. A similar arrangement is afforded for the conductors 143B and 143C.

The resistor switch 25 is securely connected between the metallic end shields 22 and 23 as previously mentioned. To this purpose the end cap spider 126, FIGS. 2 and 4, is provided with lugs 147 and 148 through which bolts (not shown) may be inserted to connect the end of the resistor switch 25 to the shield 22. A similar arrangement is provided in the end closure 59 wherein a pair of lugs 149, one of which is shown in FIG. 2, are provided for securing the end of the resistor switch 25 to the metallic shield 23. Thus, the resistor switch 25 is in parallel with the interrupter contacts. The resistor switch is inserted or closed just prior to the closing of the interrupter contacts 20 for damping overvoltage in the line which occurs during closing of the interrupter contacts 20. It will be appreciated that with the particular circuit breaker 10 illustrated in FIG. 1, the resistor switches associated with each of the interrupters 16, 17, 18 and 19 will be connected in series relationship but in parallel relationship with the series connected interrupter contacts.

The embodiments of the invention in which an exclusive property or privilege is claimed are defined as follows:

1. In a gas insulated circuit breaker having an enclosure containing an insulating gas at a relatively low pressure;

an interrupter within said enclosure and having a pair of contacts movable relative to each other between open and closed positions;

a plurality of independent resistance means connected in parallel with each other, each of said plurality of resistance means including a plurality of individual resistance elements arranged in stacked array, each stack of individual resistance elements being biased into intimate engagement, said stacks of resistance elements being enclosed in a housing;

switch means operable when actuated to a closed position to connect said resistance means in parallel with said interrupter contacts; and, operating means operably connected to close said interrupter contacts and to actuate said switch means to a closed position just prior to the closing of said interrupter contacts.

2. A gas insulated circuit breaker according to claim 1 wherein switch means includes a movable contact and a stationary contact; and, said stationary contact being electrically connected to all of said resistance stacks;

whereby the actuation of said switch means to closed position operates to connect all of said resistance stacks in parallelism with said interrupter contacts.

3. A gas insulated circuit breaker according to claim 2 wherein said stacks of individual resistances are maintained bodily isolated from each other.

4. A gas insulated circuit breaker according to claim 3 wherein opposing forces are applied to each end of said stacks of said individual resistances to provide for intimate contact of the individual resistances in each of said stacks.

5. In a resistor switch, a cylindrical switch housing of an insulating material;

a first metallic end member secured to one end of said housing;

a second metallic end member secured to the opposite end of said cylindrical housing;

a contact rod carried by said first metallic end member for movement between open and closed positions;

a cylindrical resistor housing disposed within said cylindrical housing;

a plurality of stacks of resistor elements disposed within said resistor housing;

a stationary contact carried by said resistor housing and connected to all of said stacks of resistor elements; and, individual conductor means connecting each of said stacks of resistor elements to said second metallic end member;

whereby a conductive circuit will be established from said second metallic end member through said parallel connected resistor stacks to said first end member upon movement of said contact rod to closed position.

6. A resistor switch according to claim 5 wherein said resistor housing is of a diameter to form a space between it and said switch housing to thereby provide for circulation of gas therebetween.

7. A resistor switch according to claim 5 wherein there is provided biasing means urging said resistor elements of the individual stacks into intimate engagement;

adjusting means operable on said biasing to regulate the force that said biasing means applies to said resistor elements.

8. A resistor switch according to claim 7 wherein there is provided insulator means operable to maintain said stacks of resistor elements insolated from each other.

9. A resistor switch according to claim 8 wherein there is provided a ceramic rod extending between said first and second metallic end members and is secured thereto; and, adjusting means operable between said second metallic end member and one end of said ceramic rod to apply a tensioning force to said ceramic rod to thereby secure said resistor housing in operable position within said switch housing.

* * * * *